US006804918B2

(12) United States Patent
Lindgren et al.

(10) Patent No.: US 6,804,918 B2
(45) Date of Patent: Oct. 19, 2004

(54) ROOF WINDOW ASSEMBLY COMPRISING A WINDOW COMPONENT AND AN EXTERNAL SCREENING ACCESSORY

(75) Inventors: Claes Lindgren, Farum (DK); Birgitte Hansen, Valby (DK); Samuel Howard Darmer, Greenwood, SC (US); Morten Falk Reventlow, Frederiksberg (DK); Brent Møller, Gentofte (DK); Lars Erdmann, København (DK)

(73) Assignee: VKR Holding A/S, Søborg (DK)

( * ) Notice: Subject to any disclaimer, the term of this patent is extended or adjusted under 35 U.S.C. 154(b) by 129 days.

(21) Appl. No.: 09/803,668

(22) Filed: Mar. 12, 2001

(65) Prior Publication Data

US 2002/0095886 A1 Jul. 25, 2002

(30) Foreign Application Priority Data

Jan. 19, 2001 (DK) ..... 2001 00105

(51) Int. Cl.[7] ..... E04B 1/346

(52) U.S. Cl. ..... 52/72; 52/66; 52/200; 52/203

(58) Field of Search ..... 52/72, 66, 200, 52/202, 203; 99/61, 63; 160/270, 271

(56) References Cited

U.S. PATENT DOCUMENTS

| | | | | | |
|---|---|---|---|---|---|
| 1,796,760 | A | * | 3/1931 | Norquist et al. | 160/271 |
| 2,221,005 | A | * | 11/1940 | Reese | 52/202 |
| 3,815,299 | A | * | 6/1974 | Sorensen et al. | 52/66 |
| 5,105,868 | A | * | 4/1992 | Riise | 160/90 |
| 5,115,601 | A | * | 5/1992 | Yamaguchi et al. | 52/1 |
| 5,555,683 | A | * | 9/1996 | Schroeder | 52/200 |
| 5,913,785 | A | * | 6/1999 | M.o slashed.ller et al. | 52/200 |
| 5,953,869 | A | | 9/1999 | Balfour et al. | |
| 6,109,331 | A | * | 8/2000 | Story, Jr. | 160/371 |
| 6,138,738 | A | | 10/2000 | Moller et al. | |

FOREIGN PATENT DOCUMENTS

| | | |
|---|---|---|
| DE | 2549935 | 5/1977 |
| DE | 3642464 | 7/1988 |
| DE | 4446412 | 6/1996 |
| GB | 943643 | 12/1963 |
| WO | WO 94/00655 | 1/1994 |
| WO | WO 95/28535 | 10/1995 |
| WO | WO 98/22682 | 5/1998 |
| WO | WO 98/22684 | 5/1998 |
| WO | WO 98/22685 | 5/1998 |
| WO | WO 98/22686 | 5/1998 |

* cited by examiner

*Primary Examiner*—Carl D. Friedman
*Assistant Examiner*—Basil Katcheves
(74) *Attorney, Agent, or Firm*—McGinn & Gibb, PLLC

(57) ABSTRACT

The roof window assembly comprises a main frame component and a window component including a glazing element. In order to reduce the influx of light an external screening accessory is provided. The screening accessory comprises an elongate housing extending in parallel with the top and bottom members of the frame and from which a screening member is retractable by movement parallel to the side members of the frame. An end member connected with a free end of the screening member extends throughout the width of the window frame and includes engaging means at either end of the end member for engagement with a transverse inwards recess in the outer side of each side member of the window frame.

11 Claims, 3 Drawing Sheets

ROOF WINDOW ASSEMBLY COMPRISING A WINDOW COMPONENT AND AN EXTERNAL SCREENING ACCESSORY

CROSS-REFERENCE TO RELATED APPLICATIONS

The present application claims the benefit of priority from Danish patent application No. PA 2001 00105 filed on Jan. 19, 2001.

BACKGROUND OF THE INVENTION

The present invention relates to roof window assemblies comprising a window component and at least one screening accessory for mounting on the exterior side of the window component.

Traditionally, external screening accessories to be used with such roof window assemblies comprise guide rails integral with the housing and which are fastened to the side members of the frame during mounting. However, these guide rails contribute to the height of the roof window in a direction perpendicular to the roof surface. This is not desirable, ia. from an aesthetic point of view.

BRIEF SUMMARY OF THE INVENTION

It is an object of the invention to provide a window component which makes it possible to design a window with a low installation height.

According to the invention, a window component is provided, said window component comprising a substantially rectangular glazing element with external and internal major surfaces, and a window frame including a top member, two side members and a bottom member, said window frame members engaging edge zones of said external major surface of the glazing element along all sides thereof, wherein said window frame is made of profile material having substantially L-shaped cross-section comprising a first profile wall for engagement with said edge zones of said external major surface of the glazing element and a second profile wall extending generally at substantially right angles to said first profile wall, the second profile wall of at least the side members of the window frame providing at an external side thereof a transverse inwards recess extending in the longitudinal direction of the frame member, said roof window assembly further comprising an external screening accessory comprising an elongate housing extending in parallel with the top and bottom members of the frame, a screening member accommodated in said housing to be retractable therefrom by movement parallel to the side members of the frame and an end member connected with a free end of said screening member and extending throughout the width of the window frame parallel to the top and bottom members of the frame, engaging means being provided at either end of said end member for engagement with said transverse inwards recess of the second profile wall of each side of the window frame of the window component.

By making the engagement means for the screening accessory integral with the window frame, the guide rails employed in prior art designs become superfluous.

In another aspect of the invention, a roof window assembly is provided.

In yet another aspect, a screening assembly is provided.

Further structural and operational details of preferred designs of roof window assemblies and components embodying the invention and advantages obtained thereby will become apparent from the appended drawings and the detailed description to follow.

BRIEF DESCRIPTION OF THE SEVERAL VIEWS OF THE DRAWING

Examples of the invention will now be explained below with reference to the very schematic drawings, in which.

DETAILED DESCRIPTION OF THE INVENTION

Figure 1:
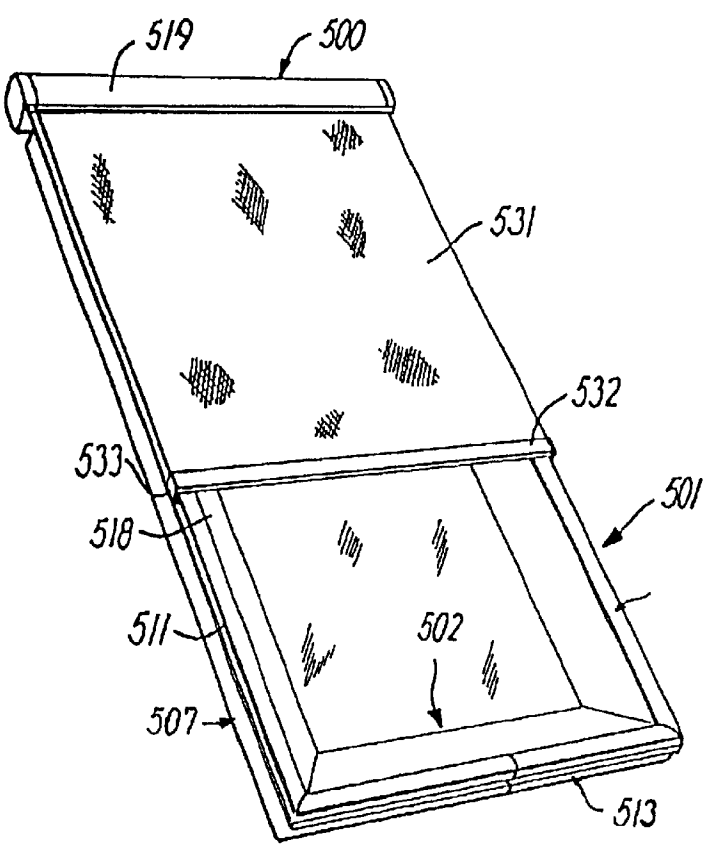
FIG. 1 shows a perspective view of a roof window assembly according to the invention with an external screening accessory.
Figure 3:
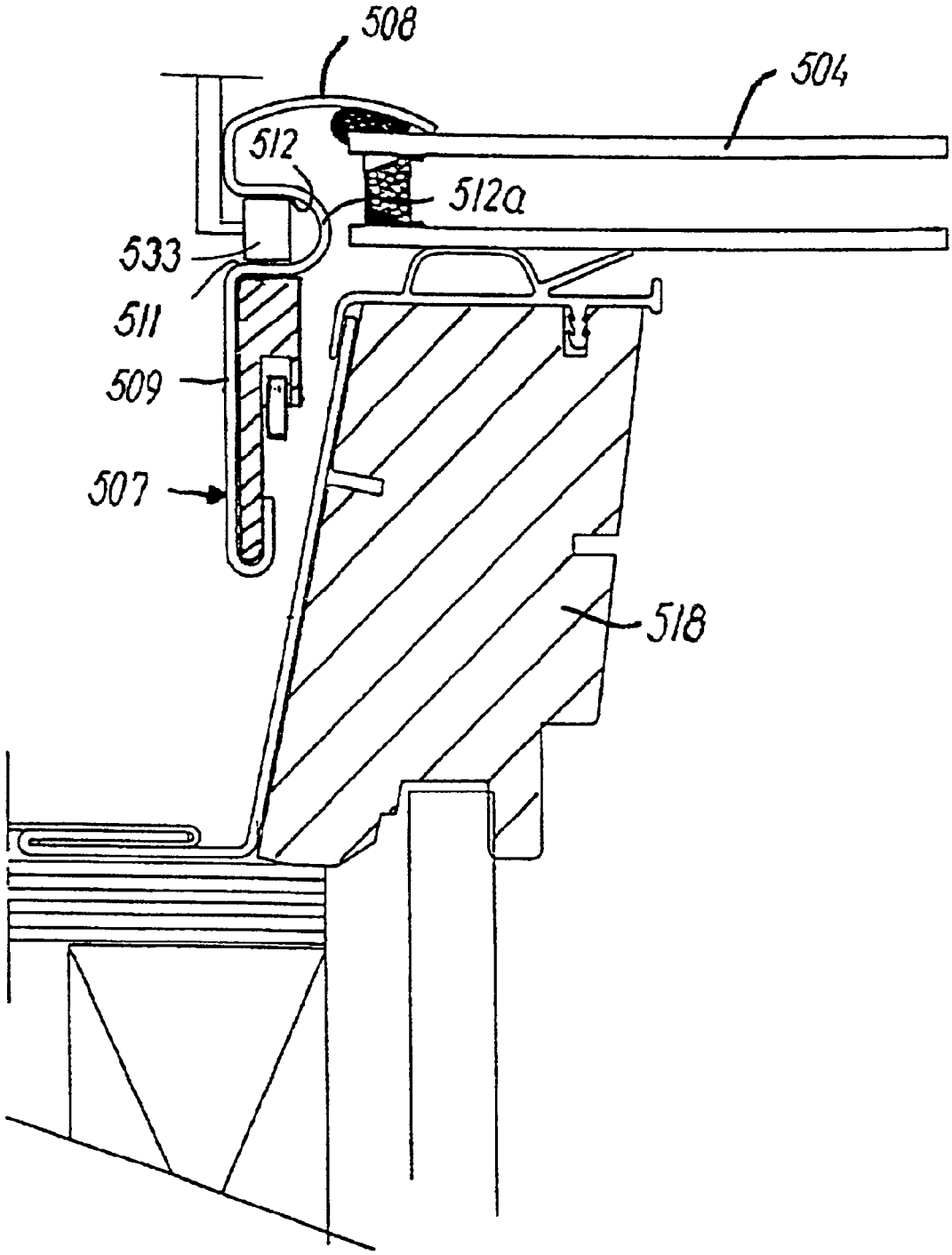
FIG. 3 shows a sectional view of the roof window assembly of FIG. 1 along the line III—III.

Referring now to the embodiment shown in FIGS. 1 and 3, the roof window assembly comprises a window component 501 and a main frame component including a top member, a bottom member and two side members, of which a side member 518 is shown in detail in FIG. 3.

The window component 501 comprises a substantially rectangular glazing element 504, which would in most cases be an insulating glass unit. The glazing element 504 could also, as will be described in further detail in the following, be a non-insulating element e.g. comprising a single glass layer of be made of a transparent plastic material for use e.g. in a skylight installation.

On all sides of the glazing element 504, edge zones of the external major surface of the glazing element are engaged by a window frame having a top member, a bottom member 513 and two side members 507 and 514. In the embodiment illustrated in FIGS. 1 and 3, each window frame member is made of sheet metal profile such as aluminum profile of a thickness of e.g. 1.5 mm. The frame could alternatively be made, however, from an extruded metal profile or from plastic profile material.

In the embodiment shown in FIGS. 1 and 3, the window frame is, throughout its perimeter length along the bottom member 513, the top member and the two side members 507 and 514 formed with the same generally L-shaped cross-section comprising a first profile wall 508 for engagement with the edge zones of the glazing element and a second profile wall 509 extending generally at substantially right angles to the first profile wall 508 and substantially parallel to the perimeter sides of the glazing element 504.

In the embodiment illustrated in FIGS. 1 and 3, the second profile wall 509 in each of the top, bottom and side members of the window frame is formed at a separation from the first profile wall 508 with a transverse inwards recess 511 provided by a relatively narrow groove-like longitudinal depression 512 having a bottom section 512*a* positioned substantially opposite a side edge of the glazing element 504.

Figure 2:
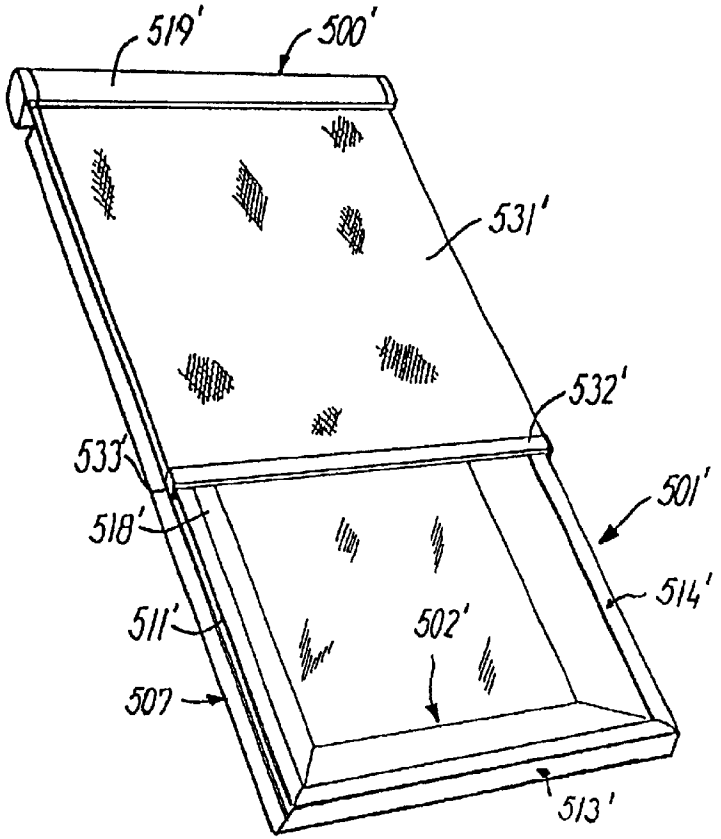
FIG. 2 is a view corresponding to FIG. 1 of an alternative embodiment of the window component.

In the embodiment illustrated in FIG. 2, in which elements having the same or analogous function as in the FIG. 1 embodiment carry the same reference numerals to which a "'" has been added, the second profile wall 509 in each side member 507',514' of the window frame is, as is the case in the FIG. 1 embodiment, formed with a transverse inwards recess 511' of the same shape as the recess 511 of that Figure. However, the bottom member 513' of the window frame of FIG. 2 presents a substantially plane second profile wall, whereas the second profile wall of the top member may comprise a recess or, alternatively, be substantially plane as well.

The recess 511,511' formed in the second profile wall 509,509' of at least the side members 507,514; 507',514' of the window frame provides as shown in the perspective views in FIGS. 1 and 2 an advantageous possibility for movement, guiding and control of an external screening accessory 500,500' of the kind comprising an elongate housing 519,519' extending along the top member of the window frame and a screening member, e.g. in the form of a heat reflecting screening web 531,531' accommodated in rolled-up form in the housing 519,519' to be retractable therefrom by movement parallel to the side members 507, 514; 507',514' of the window frame.

A free end of the screening web 531,531' is connected with an end member 532,532', which extends throughout and somewhat beyond the width of the window component 501,501' and is provided at either end with engaging means e.g. in the form of rollers 533,533' for engagement with and guiding in the depressions 511,511' from the external side of the window component 501,501'.

In the embodiment of FIG. 1, and in the case in which the top member of the window frame of the FIG. 2 embodiment is provided with a recess as are the side members 507',514', the housing 519,519' may be provided with engagement means for engaging the recess of the top member.

Thus, the recess formed in at least the window frame side members 507,514; 507',514' provides a window assembly, which is prepared for very easy installation of an external screening accessory.

Alternative designs of the profile of the window frame members are shown in FIGS. 4 to 7. It is noted in this respect that it is only necessary to provide each side member of window frame with a recess in order to provide guidance for the screening accessory, and the top and bottom members of the window frame may thus differ in shape from the side members corresponding to the embodiment of FIG. 2. However, a uniform cross-section of the window frame members throughout its length is of course conceivable as well.

Figure 4:
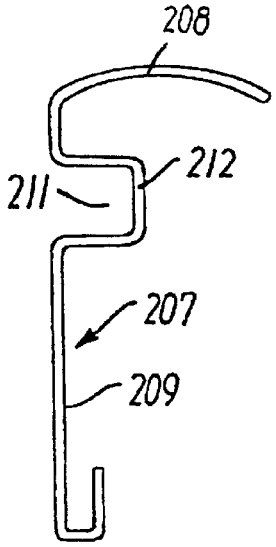
FIGS. 4 to 7 show schematic sectional views of alternative profile shapes of the window frame shown in FIGS. 1 to 3.

In FIG. 4, a transverse inwards recess 211 is provided in the second wall portion 209 of the window frame member 207 by a relatively narrow groove-like longitudinal depression having a substantially flat bottom section 212.

Figure 5:
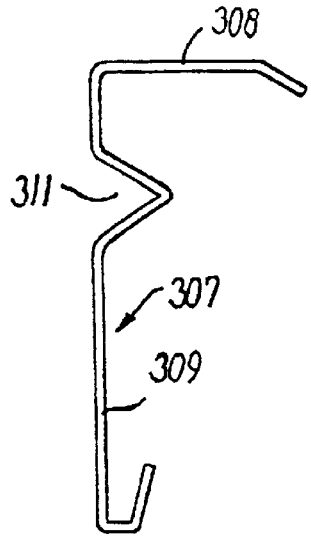

In the FIG. 5 embodiment, the transverse inwards recess 311 is provided by a longitudinal depression having a substantially V-shaped cross-section.

Figure 6:
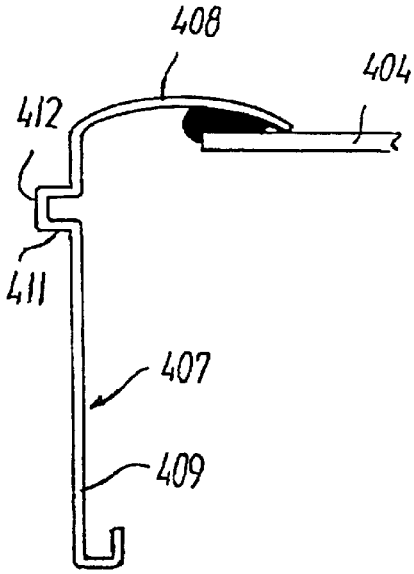

In the FIG. 6 embodiment, the transverse inwards recess 411 is formed by a wall part 412 projecting outwardly from the second profile wall. With respect to this embodiment it is furthermore to be noted that the glazing element 404 is a non-insulating element e.g. comprising a single glass layer or be made of a transparent plastic material for use e.g. in a skylight installation.

Figure 7:
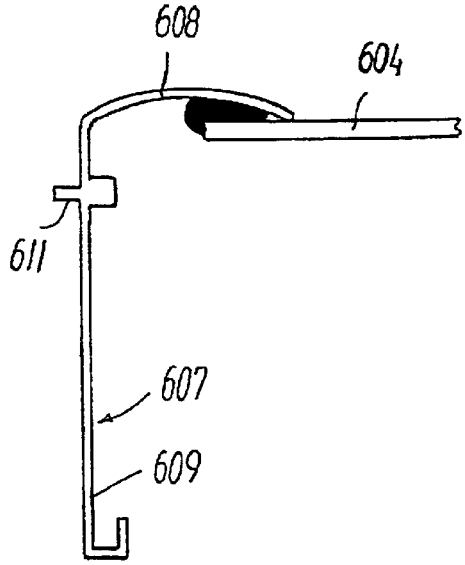

In the embodiment shown in FIG. 7, the window frame member 607 is made as an extruded profile, e.g. of aluminum. In this case the recess 611 may be formed by a rib 612 projecting from the external side of the second profile wall 609. As in the FIG. 6 embodiment, the glazing element 604 is a non-insulating element e.g. comprising a single glass layer or be made of a transparent plastic material for use e.g. in a skylight installation.

The invention should not be regarded as being limited to the embodiments described in the above but various modifications and combinations of the shown embodiments may be carried out without departing from the scope of the following claims.

For instance, the screening assembly may be positioned at the bottom member of the roof window assembly and be fastened to the main frame component instead of the to the window frame. Furthermore, other cross-sectional shapes of the window frame side members are conceivable as long as they provide for a recess for movement, guiding and control of an external screening accessory.

What is claimed is:

1. A roof window assembly comprising:

a substantially rectangular glazing element with external and internal major surfaces, and a window frame including a top member, two side members and a bottom member, said window frame members engaging edge zones of said external major surface of the glazing element along all sides thereof, wherein said window frame is made of profile material having substantially L-shaped cross-section comprising a first profile wall for engagement with said edge zones of said external major surface of the glazing element and a second profile wall extending generally at substantially right angles to said first profile wall, the second profile wall of at least the side members of the window frame providing at an external side thereof a transverse inwards recess extending in the longitudinal direction of the frame member, said roof window assembly further comprising at least one external screening accessory comprising an elongate housing extending in parallel with the top and bottom members of the frame, a screening member accommodated in said housing to be retractable therefrom by movement parallel to the side members of the frame and an end member connected with a free end of said screening member and extending throughout the width of the window frame parallel to the top and bottom members of the frame, engaging means being provided at either end of said end member for engagement with said transverse inwards recess of the second profile wall of each side of the window frame of the window component.

2. A roof window assembly as claimed in claim 1, wherein the second profile wall of the top member of the window frame provides at an external side thereof a transverse inwards recess extending in the longitudinal direction of the frame member, said housing being connected with the recess of the top member of the frame.

3. A roof window assembly as claimed in claim 1, wherein the second profile wall of the bottom member of the window frame provides at an external side thereof a transverse inwards recess extending in the longitudinal direction of the frame member.

4. A roof window assembly as claimed in claim 2, wherein the second profile wall of the member of the window frame provides at an external side thereof a transverse inwards recess extending in the longitudinal direction of the frame member, providing the frame throughout its length with the same substantially L-shaped cross-section.

5. A roof window assembly as claimed in claim 1, wherein said transverse inwards recess is provided by a relatively narrow groove-like longitudinal depression having a substantially part-cylindrical bottom section.

6. A roof window assembly as claimed in claim 1, wherein said transverse inwards recess is provided by a relatively narrow groove-like longitudinal depression having a substantially flat bottom section.

7. A roof window assembly as claimed in claim 1, wherein said transverse inwards recess is provided by a longitudinal depression having a substantially V-shaped cross-section.

8. A roof window assembly as claimed in claim 1, wherein said transverse inwards recess is formed by a wall part projecting outwardly from the second profile wall.

9. A roof window assembly as claimed in claim 1, wherein said transverse inwards recess is formed by a rib projecting outwardly from the second profile wall.

10. A roof window assembly comprising:

a main frame component for stationary connection with supporting means of a roof structure and including a top member, side members and a bottom member in a rectangular configuration, a substantially rectangular window component including a glazing element with external and internal major surfaces, and a window frame including a top member, two side members and a bottom member, said window frame members engaging edge zones of said external major surface of the glazing element along all sides thereof, wherein said window frame is made of profile material having substantially L-shaped cross-section comprising a first profile wall for engagement with said edge zones of said external major surface of the glazing element and a second profile wall extending generally at substantially right anales to said first profile wall, the second profile wall of at least the side members of the window frame providing at an external side thereof a transverse inwards recess extending in the longitudinal direction of the frame member, said roof window assembly further comprising at least one external screening accessory comprising an elongate housing extending in parallel with the top and bottom members of the frame, a screening member accommodated in said housing to be retractable therefrom by movement parallel to the side members of the frame and an end member connected with a free end of said screening member and extending throughout the width of the window frame parallel to the top and bottom members of the frame, engaging means being provided at either end of said end member for engagement with said transverse inwards recess of the second profile wall of each side of the window frame of the window component.

11. An external screening accessory comprising an elongate housing, a screening member accommodated in said housing to be retractable therefrom by movement perpendicularly to the housing, and an end member connected with a free end of said screening member and extending parallel with the housing, engaging means being provided at either end of said end member, said engaging means being adapted to engage a transverse inwards recess of a respective side member of a window frame, said engaging means comprising structure extending transversely inwards for engaging a transverse inwards recess of a respective side member of a window frame.

* * * * *